United States Patent [19]

Holt et al.

[11] 4,075,816

[45] Feb. 28, 1978

[54] WRAPPER SHEET FEED FOR WRAPPING MACHINE

[75] Inventors: Ronald Holt, Battle Creek; Daniel J. Smith, Kalamazoo, both of Mich.

[73] Assignee: Franklin Electric Subsidiaries, Inc., Bluffton, Ind.

[21] Appl. No.: 757,365

[22] Filed: Jan. 6, 1977

[51] Int. Cl.[2] ..... B65B 57/12; B65H 7/02

[52] U.S. Cl. ..... 53/74; 53/389; 271/258; 271/273

[58] Field of Search ..... 53/64, 73, 74, 389; 271/258, 265, 273

[56] References Cited

U.S. PATENT DOCUMENTS

| | | | |
|---|---|---|---|
| 2,982,077 | 5/1961 | Smith | 53/389 |
| 3,421,285 | 1/1969 | Barker | 53/61 |
| 3,762,700 | 10/1973 | Peterson et al. | 271/273 |
| 3,890,886 | 6/1975 | Fessler et al. | 53/389 X |

*Primary Examiner*—Travis S. McGehee
*Attorney, Agent, or Firm*—Austin A. Webb

[57] ABSTRACT

A wrapping machine has film feed rolls driven through a one revolution clutch to advance a wrapper length of stock in each cycle, past a continuously driven cutter, to separately driven and intermittently operating sheet locating belts. First sensing means disengage the clutch when no articles are ready to be wrapped. Second sensing means stop the belts in correct wrapping position of the sheet. Movable pressure rollers hold sheets on the belts, to stop with belts. Electrically actuated lifting devices lift the rollers from the belts. Cyclically driven switch means and holding circuits are connected to successively engage an electric clutch to drive the belts while opening a circuit to a brake for stopping the belts and deenergizing the roller lifting devices, then deenergize and disengage the electric clutch while conditioning the circuit to the brake for completion by the second sensing device, then energize the lifting devices for lifting the rollers from the belts. Other cyclically actuated switches and holding circuits condition the first sensing means to disengage the one revolution clutch and retract a movable striker blade from coacting cutting relation with the cutter when the first sensing device is activated during a short interval near the end of the rotational cycle of the one revolution clutch.

8 Claims, 12 Drawing Figures

WRAPPER SHEET FEED FOR WRAPPING MACHINE

OUTLINE OF INVENTION

The present invention involves improvements in a similar wrappig machine disclosed in U.S. Pat. No. 2,982,077 to John W. Smith. Several interreacting changes eliminate inertia shocks of starting and stopping the film cutting and perforating blades, permitting the use of lighter drive and support parts. The addition of an oscillatably mounted pressure roll coacting with the wrapper locating belts and the wrapper sheet thereon provides more precise location of each wrapper sheet and at a greatly increased speed or frequency of wrapping. The provision of a multicontact reed switch with an actuating magnet which makes one revolution in fixed synchronism with each wrapping cycle of the machine and a sensor which senses the arrival of the wrapper sheet permit the precise control of the wrapper sheet.

DRAWINGS

The drawings of which there are nine sheets, illustrate a preferred form of the invention.

FIG. 3 is an enlarged top plan view of the wrapper feed portion of FIGS. 1 and 2.

GENERAL ARRANGEMENT AND DRIVE CONNECTIONS

Figure 1:
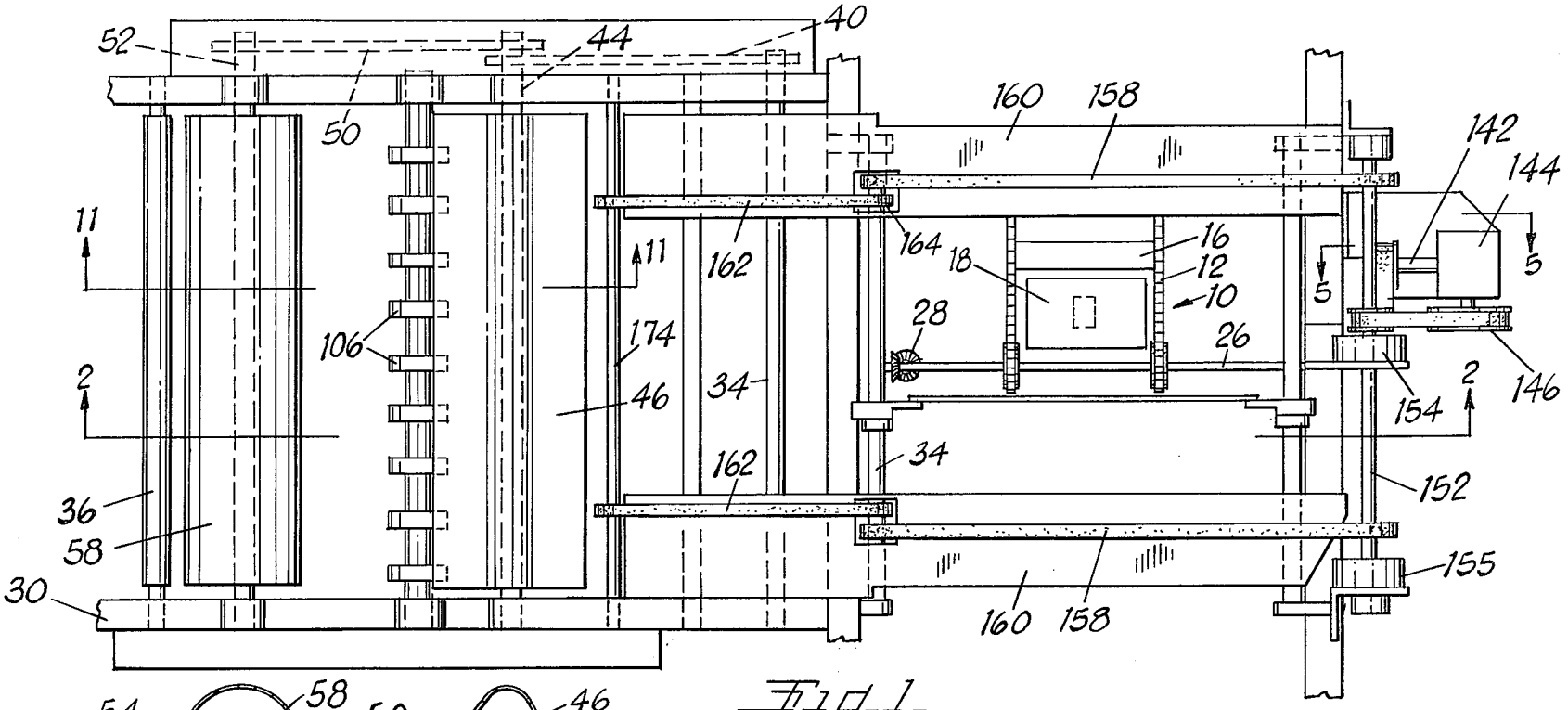
FIG. 1 is a fragmentary top plan view with parts broken away of the wrapper feed of the invention in overlying coacting relation to the article feeding mechanism of a wrapping machine.
Figure 2:
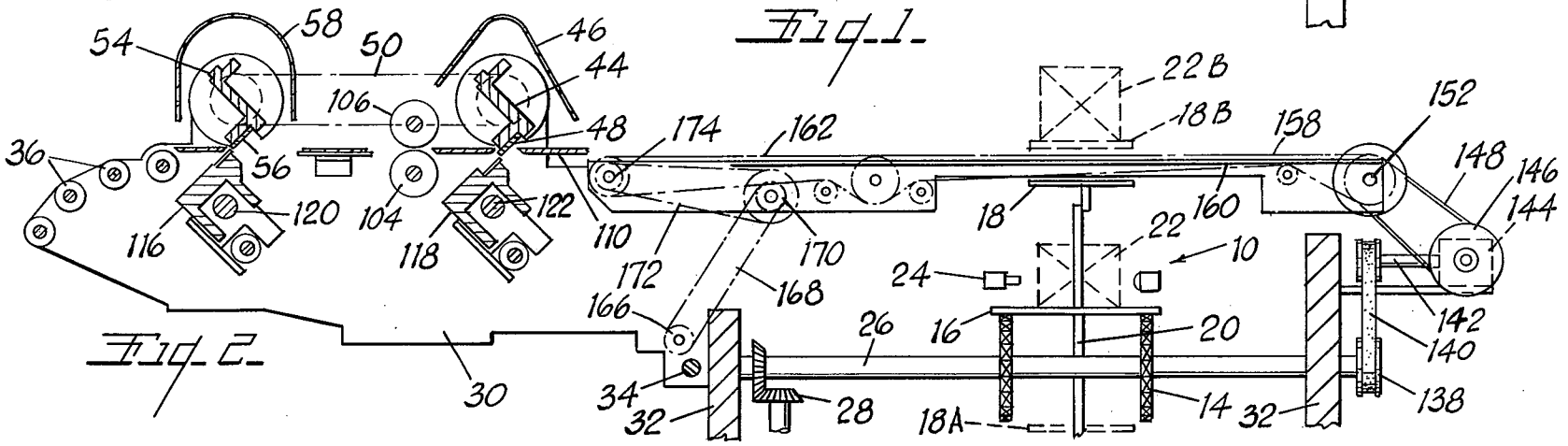
FIG. 2 is a fragmentary vertical cross sectional view of wrapper drive and feed mechanism taken along the line 2—2 in FIG. 1.
Figure 2:
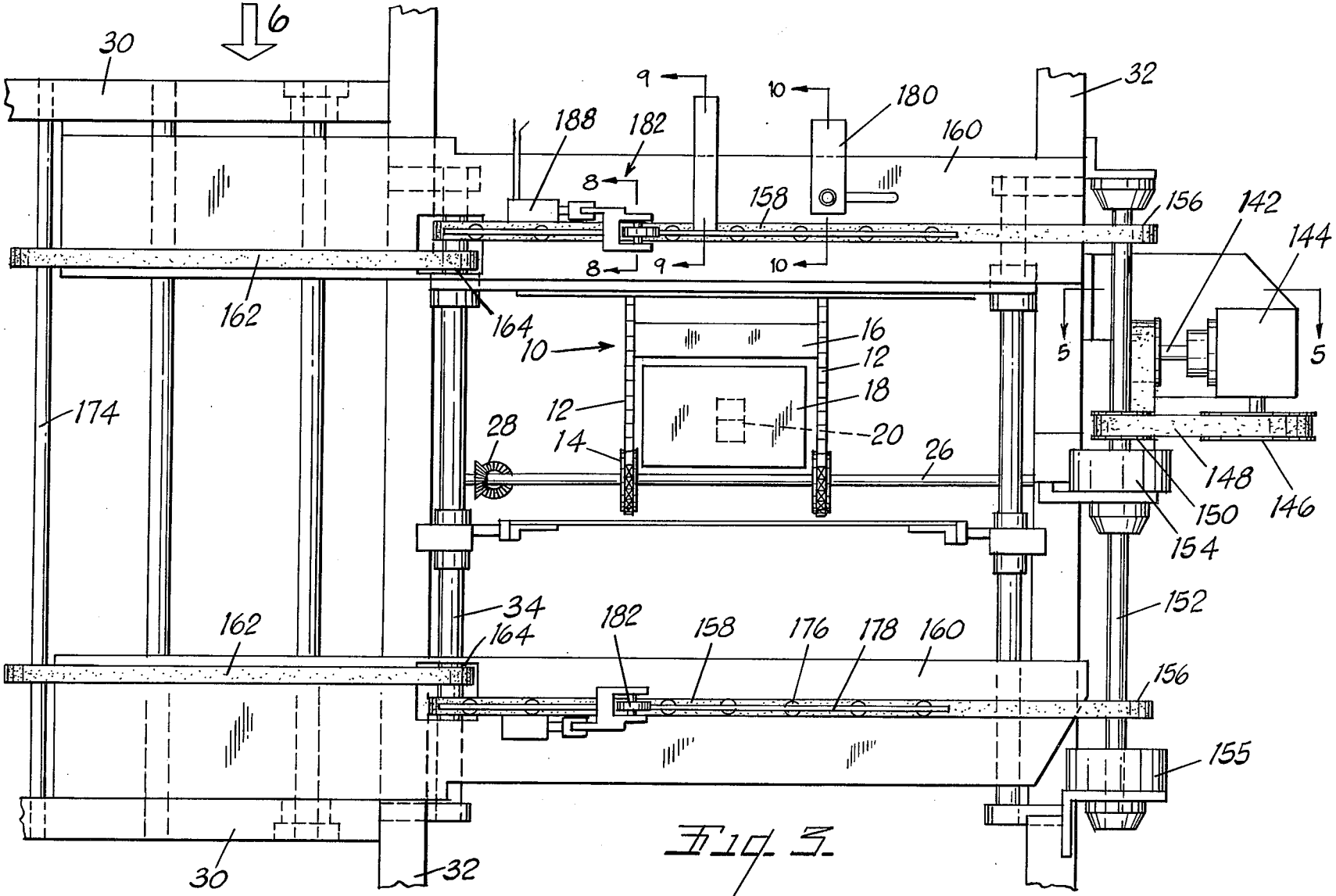
Figure 4:
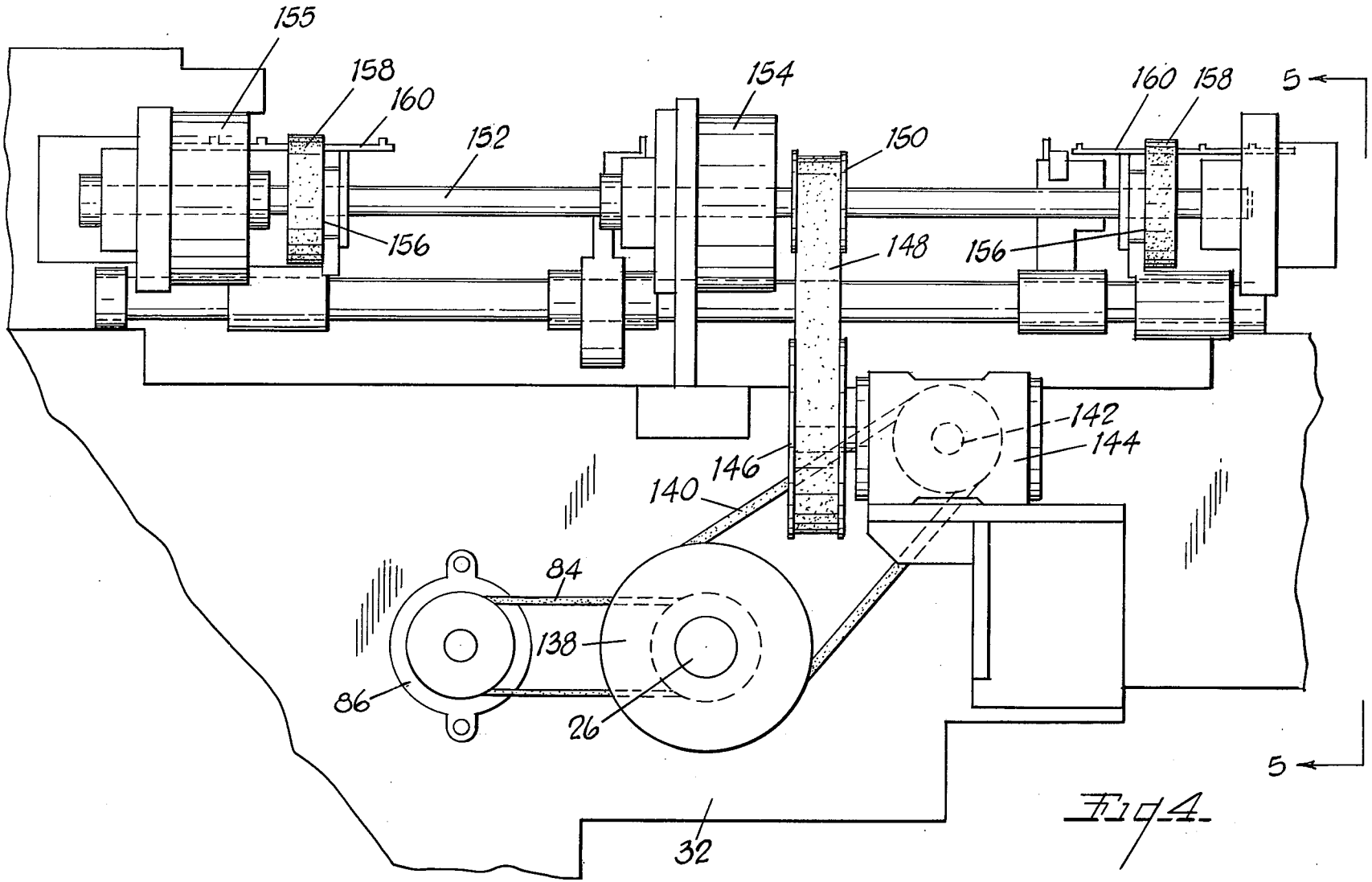
FIG. 4 is an enlarged front elevational view of the drive mechanism to the wrapper feed shown in FIG. 3.
Figure 5:
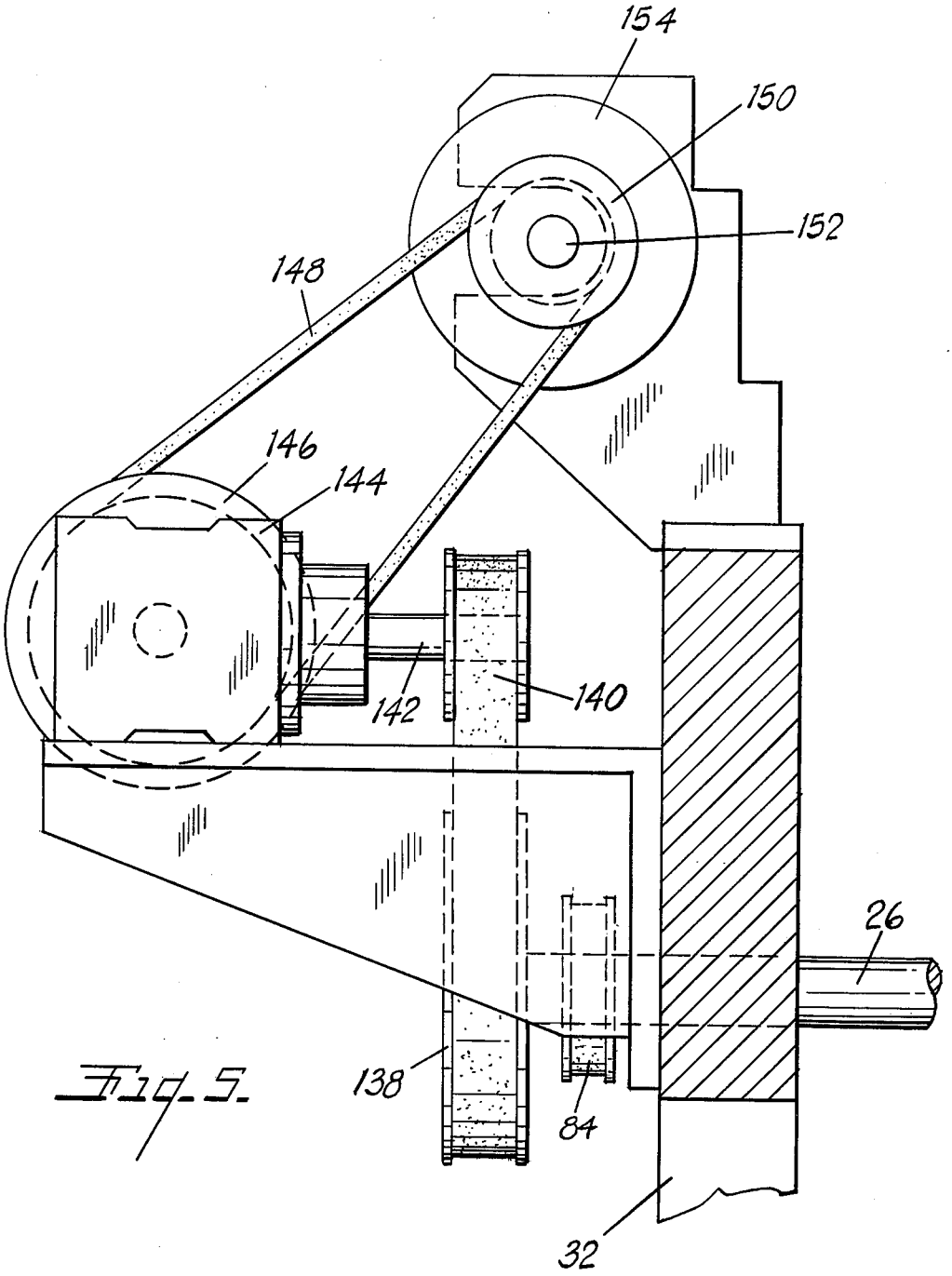
FIG. 5 is a further enlarged cross sectional view taken along the plane of the lines 5—5 in FIGS. 1, 3 and 4.

The article feed conveyor which brings articles to be wrapped into the machine is generally indicated at 10 and includes conveyor chains 12 trained over drive sprockets 14 and provided with spaced article supports or flights 16. An elevator 18 with a lift rod 20 driven by cams (not shown) reciprocates in the spaces between the flights 16 and lifts successive articles 22 (indicated by dotted lines) to the wrapper film and sheet feeding apparatus of the invention. An article sensing photo electric switch 24 senses the absence of articles to be wrapped and controls the operation of the wrapper feed when the article feed is temporarily interrupted. The shaft 26 which drives the chains 12 is driven from the bevel gears 28 and runs continuously when the machine is operating. Shaft 26 makes one revolution per cycle to bring an article to the elevator 18 at the same time in each cycle. The elevator 18 is driven in synchronism with the flights 16 by drive mechanism which is old and is not illustrated.

Figure 11:
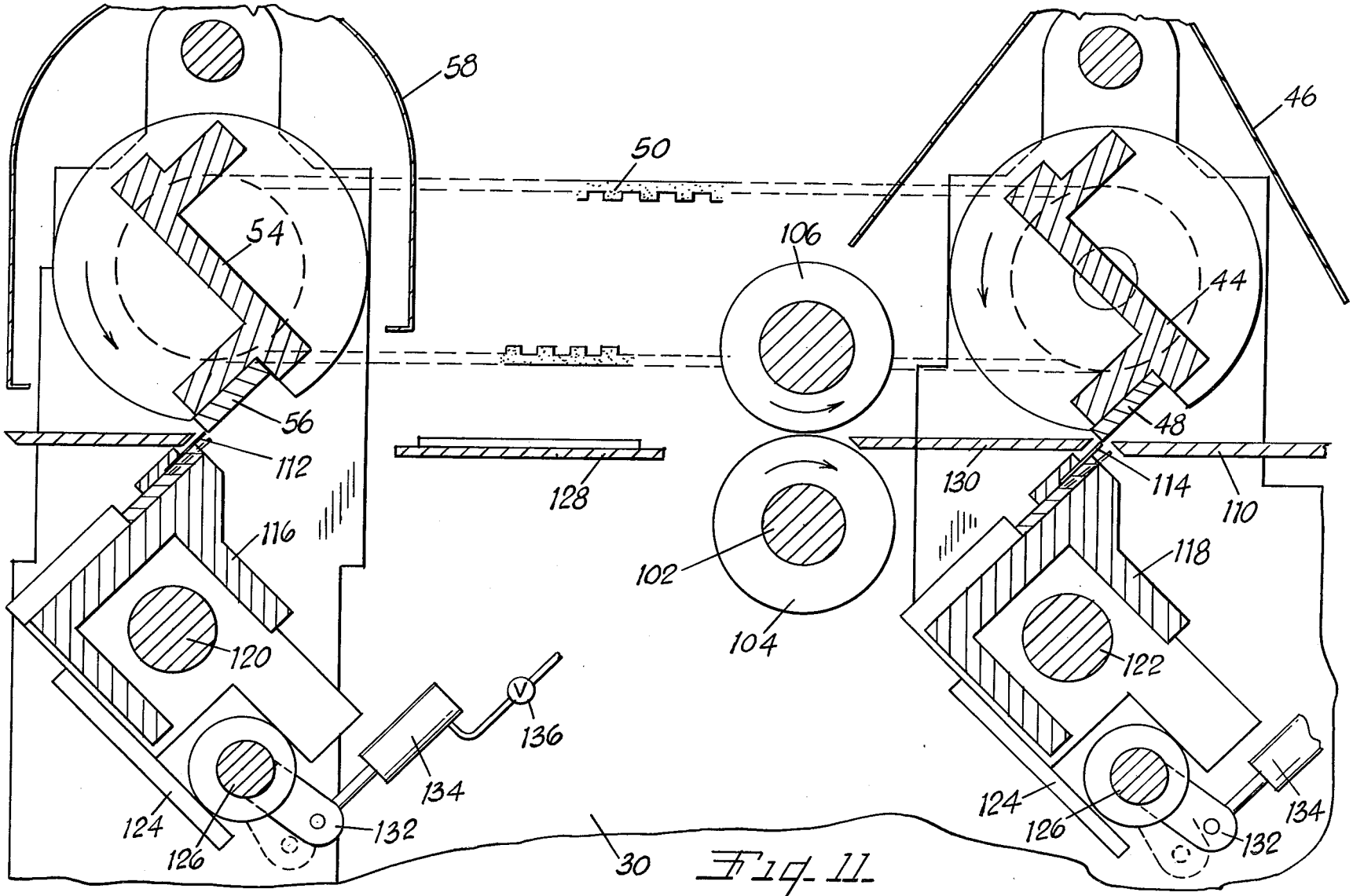
FIG. 11 is an enlarged fragmentary vertical cross sectional view taken along the plane of the line 11—11 in FIG. 1 showing the wrapper feed rolls and sheet cutting and perforating blades in larger size than in FIG. 2.

The film feed and wrapper sheet forwarding mechanism is shown best in FIGS. 1, 2, 3 and 4. The wrapper cutting and perforating blades are best shown in FIG. 11. Subframe members 30 project transversely from one side of the frame members 32 of the main frame of the machine. A drive shaft 34 driven by connections (not shown) makes one revolution per cycle of the machine, and drives the film feed and cutters as will be described in greater detail presently.

FILM FEED AND WRAPPER CUTTER

The supply of wrapper film is drawn in from a suitable supply roll over rollers 36 at the outer end of the film feed. (Left in FIGS. 1 and 2, right in FIG. 6.) Drive shaft 34 previously mentioned and located close to the main frame 32 of the machine has a first sprocket or pulley 38 keyed thereto (See FIG. 7), which continually drives the toothed belt 40 (see FIG. 6) to sprocket 42 on the shaft 44 of a cutter blade. The center part of the shaft under the guard housing 46 is of Z shaped cross section (See FIGS. 2 and 11), one arm of which carries a blade 48 for cutting individual wrapper sheets from the infeeding web. On the end of shaft 44 a toothed belt 50 connects the shaft to the shaft 52 of a second Z shaped cutter bar 54. The bar 54 carries a cutter blade 56 under the guard housing 58 for cutting perforated tear lines in each wrapper sheet. Both blades 48 and 56 are continuous straight cutting blades. The perforating action of blade 56 is obtained by structure to be described presently. It will be seen that shafts 44 and 52 and cutter blades 48 and 56 rotate continuously with shafts 34 and 26 whenever the material or article supply conveyor is operating. The blades 48 and 56 normally make cuts with each revolution except when no articles are ready to be wrapped, as will be pointed out presently.

Figure 6:
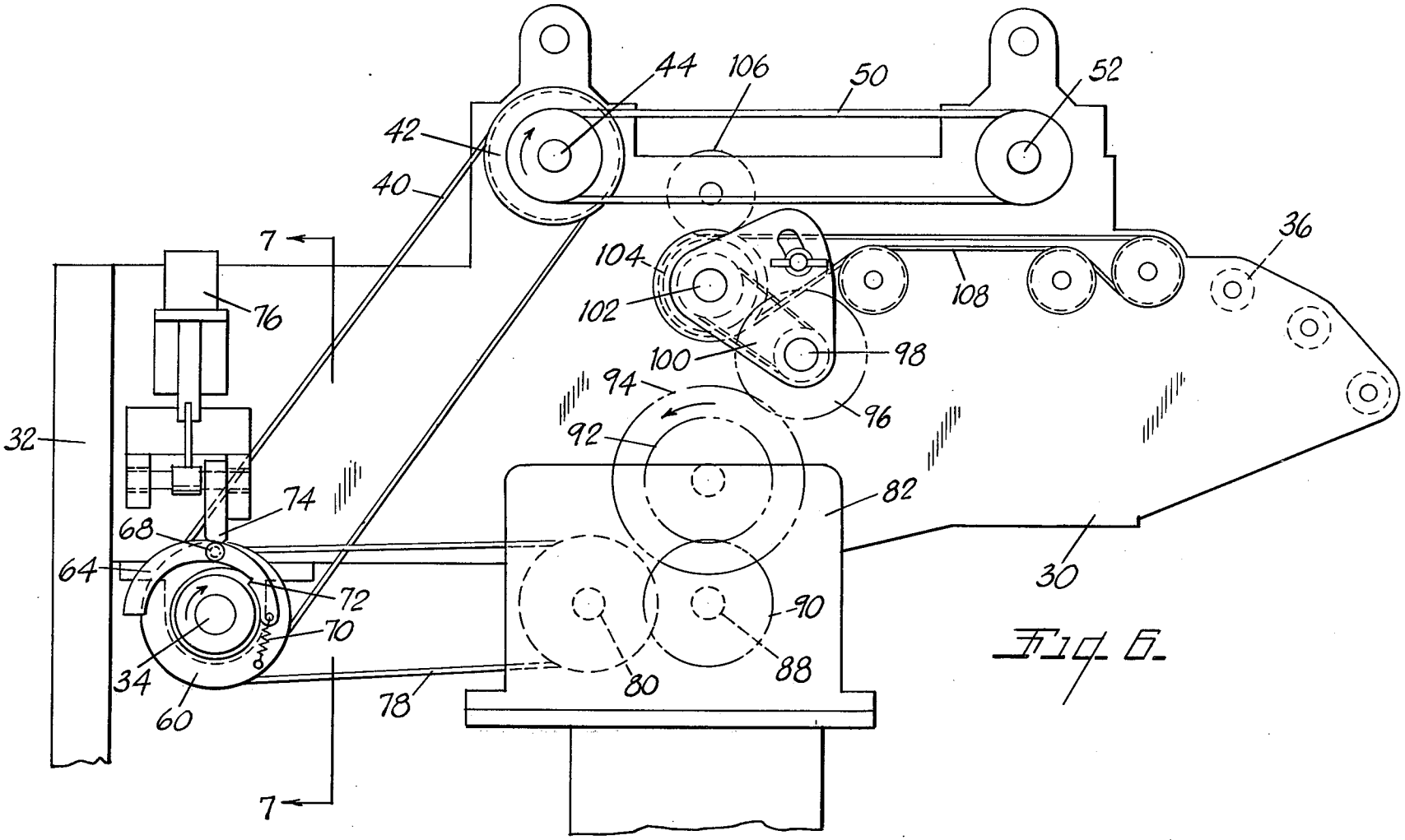
FIG. 6 is an enlarged end elevational view of the drive connections to the film feed and cutter mechanism as viewed from the right side of FIG. 3 as indicated by the arrow 6 in FIG. 3.
Figure 7:
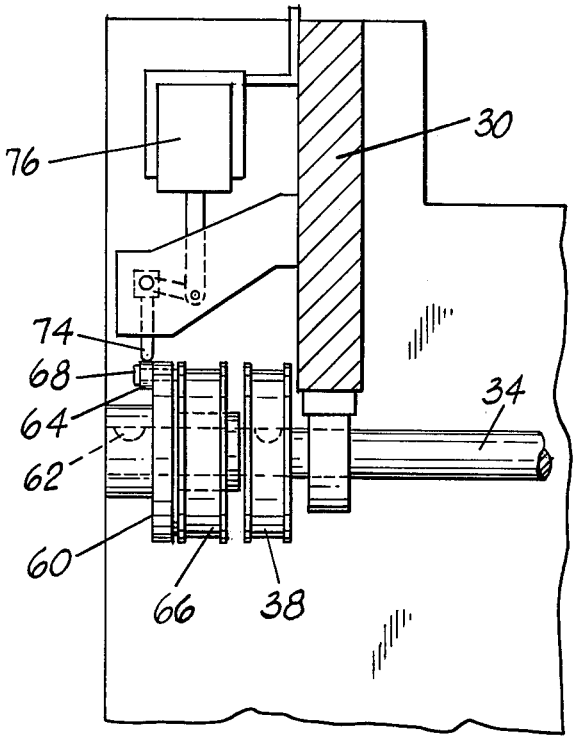
FIG. 7 is a fragmentary cross sectional view along the line 7—7 in FIG. 6.
Figure 8:
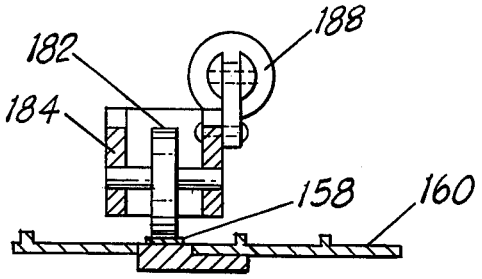
FIG. 8 is a fragmentary vertical cross sectional view through the wrapper stop roll taken along the line 8—8 in FIG. 3.
Figure 9:
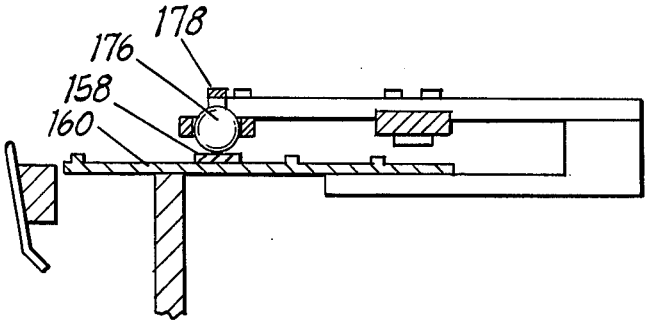
FIG. 9 is a fragmentary cross sectional view through the wrapper feed belt and a pressure ball taken along the line 9—9 in FIG. 3.
Figure 10:
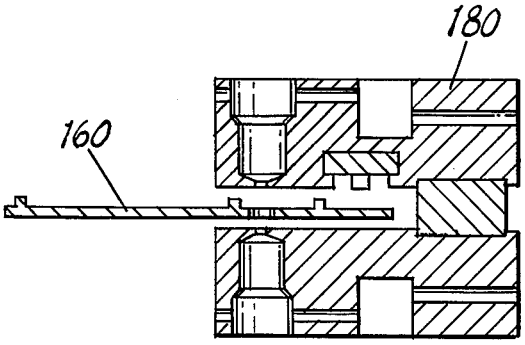
FIG. 10 is a fragmentary vertical cross sectional view through the ultrasonic sensor taken along the line 10—10 in FIG. 3.

Shaft 34 also continuously drives a clutch disc 60 through a key 62 (See FIG. 7). A spring pressed pawl or latch 64 is pivoted on the side of a second sprocket or pulley 66 by a pivot 68. (See FIG. 6) The pulley 66 is freely rotatable about a sleeve on shaft 34, and the spring 70 normally urges the notch 72 in the pawl 64 to pick up a coacting notch in the disc 60 to drive the pulley 66 from the shaft. A trip or blocking bar 74 is normally held out of engagement from the clutch pawl 64 of a solenoid 76 in the energized condition of the magnet. The magnet is energized by photo-electric sensing switch 24 when there are articles on the conveyor 10 ready to be wrapped. The clutch disc 60 and pulley 66 thus both rotate with the shaft 34 during normal wrapping operation. It should be noted that notch 72 of pawl 64 will engage the clutch in only one fixed angle of rotation of disc 60 and shaft 34. The clutch is thus a single position engageable clutch, and when engaged, pulley 66 is always in rotational registry or synchronism with shafts 34, cutter shafts 44 and 52 and supply conveyor shaft 26.

Pulley or sprocket 66 is connected by toothed belt 78 with the input shaft 80 of a differential gear box 82. Note that shafts 34 and 80 are always in rotational registry with each other, but may stop when magnet 76 is de-energized by switch 24. When once stopped, they will restart only in the same rotational relation to the article feeding conveyor 10.

The differential gear box 82 functions to advance or retract its output shaft 88 by small increments in response to an optical sensing device (not illustrated) which views or senses a code mark printed at intervals along the web of wrapping material. This keeps any design on the label and the wrappers in registry with the article to be wrapped. This device is also well known and is mentioned only to show the drive to the wrapper feed rolls. A gear 90 on out-put shaft 88 drives a gear 92 which carries a changeable gear 94. Gear 94 meshes with the swingable adjustable gear 96 to drive shaft 98 on swingable sector plate 100. Gear 96 drives shaft 102 which carries a series of driven feed rolls 104 on the underside of the infeeding web of wrapper material, in coacting relation with idling pressure rolls 106 on top of the web. Shaft 102 also drives a belt 108 to a roller for pulling the web over rollers 36. The size of change gear 94 establishes the correct peripheral speed of feed rollers to advance the correct length of web material for one wrapper sheet with each rotation of shafts 34, 80 and 88. As will be pointed out, feed rolls 104 stop (due to actuation of switch 24 and magnet 76) only when the leading end of the web material has been advanced under the cut-off cutter bar 48 and onto a supporting plate 110 (See FIGS. 2 and 11). A belt 84 driven from shaft 26 (See FIG. 4) also continuously rotates a magnet or reed switch 86. Switch 86 is of known construction and is commercially available and so is not described in greater detail than to point out that each rotation of the magnet in the switch momentarily activates three separate switches at angularly adjustable positions in the rotation of the switch. The function of the switch in the cycle of the machine will be pointed out in connection with the circuit diagram of the controls of the machine.

WRAPPER PERFORATING & CUTTING

With particular reference to FIG. 11, it will be noted that the cutter blade 48 and the perforator blade 56, which rotate continuously as previously described, coact with movable thin striker blades 112 and 114. Striker blade 112 is serrated to produce a perforated cut in coaction with blade 56, rather than a complete severing of the web stock. These blades are carried on rockable stiff channels 116 and 118 mounted on pivot shafts 120 and 122. Each channel has a yoke 124 within which an eccentric 126 is engaged to rotate to rock the channels and the striker blades to the inoperative dotted line positions shown in FIG. 11. Actuating arms 132 connected to the eccentrics 126 are rocked by the piston rods of air cylinders 134 under the control of solenoid operated valves 136. Thus, the heavy carriers 44 and 54 for the blades 48 and 56 rotate continuously whenever the machine is operating. The actuation of the solenoid valves 136 to provide cutting action will be described presently in connection with the circuit diagram of FIG. 12.

WRAPPER FORWARDING AND LOCATING

Attention is now directed to FIGS. 1, 2, 3, 4, 5, 8, 9 and 10. The previously described shaft 26 which drives the article feed conveyor 10 drives a sprocket 138 and toothed belt 140 to the input shaft 142 of a right angle gear box 144. The output shaft of the gear box drives a sprocket 146 and belt 148 to sprocket 150 which idles on shaft 152 at the rear or right end of the wrapper sheet feed table. An electric clutch 154 drivingly connects the sprocket 150 to the shaft 152 when energized. An electric brake 155 on the left end of shaft 152 stops the shaft when the brake is energized. The shaft drives two sprockets 156 which drive two wrapper locating belts 158 located on opposite sides of the elevator 18. The belts are supported on plates 160. Belts 158 are fed by forwarding belts 162 which are trained over idler sprockets 164 on the same shaft as the ends of belts 158. Belts 162 are continuously driven from previously described shaft 34. (See FIG. 2). The drive can be traced through reversing gears 166 to belt 168 and sprocket 170 from which belt 172 drives the shaft 174 and belts 162. Both belts 162 and belts 158 when operating travel at the same speed to deliver a wrapper sheet to over the article elevator 18 during each cycle.

When the wrapper sheets arrive on the locating belts 158 they are retained against the belts by weighted balls 176 held over the wrapper by retaining bars 178. When the leading edge of the wrapper sheet reaches the desired position, its presence is sensed by an ultrasonic sensor 180. (See FIG. 10) This actuates the controls of the brake 155 to stop the belts 158. However, the inertia of the rapidly rotating balls 176 tends to over-feed the wrapper sheet, and to stop or prevent this over-feed a pressure roller indicated at 182 is lowered against the wrapper sheet on each belt. The pressure rollers 182 are shown most clearly in FIG. 8 which shows each roller supported on a lever arm 184 and are weight or spring biased downwardly into contact with the belts and the wrapper sheets. The arms are raised under the control of solenoids 188. The connections are conventionally illustrated, and the solenoids are shown in the circuit diagram. Since the pressure rollers 182 would interfere with the wrapper sheet being pulled transversely off of the belts 158 by the ascending article, the rollers must be raised from the wrapper sheets and belts before this occurs.

CIRCUIT DIAGRAM AND OPERATION CYCLE

Figure 12:
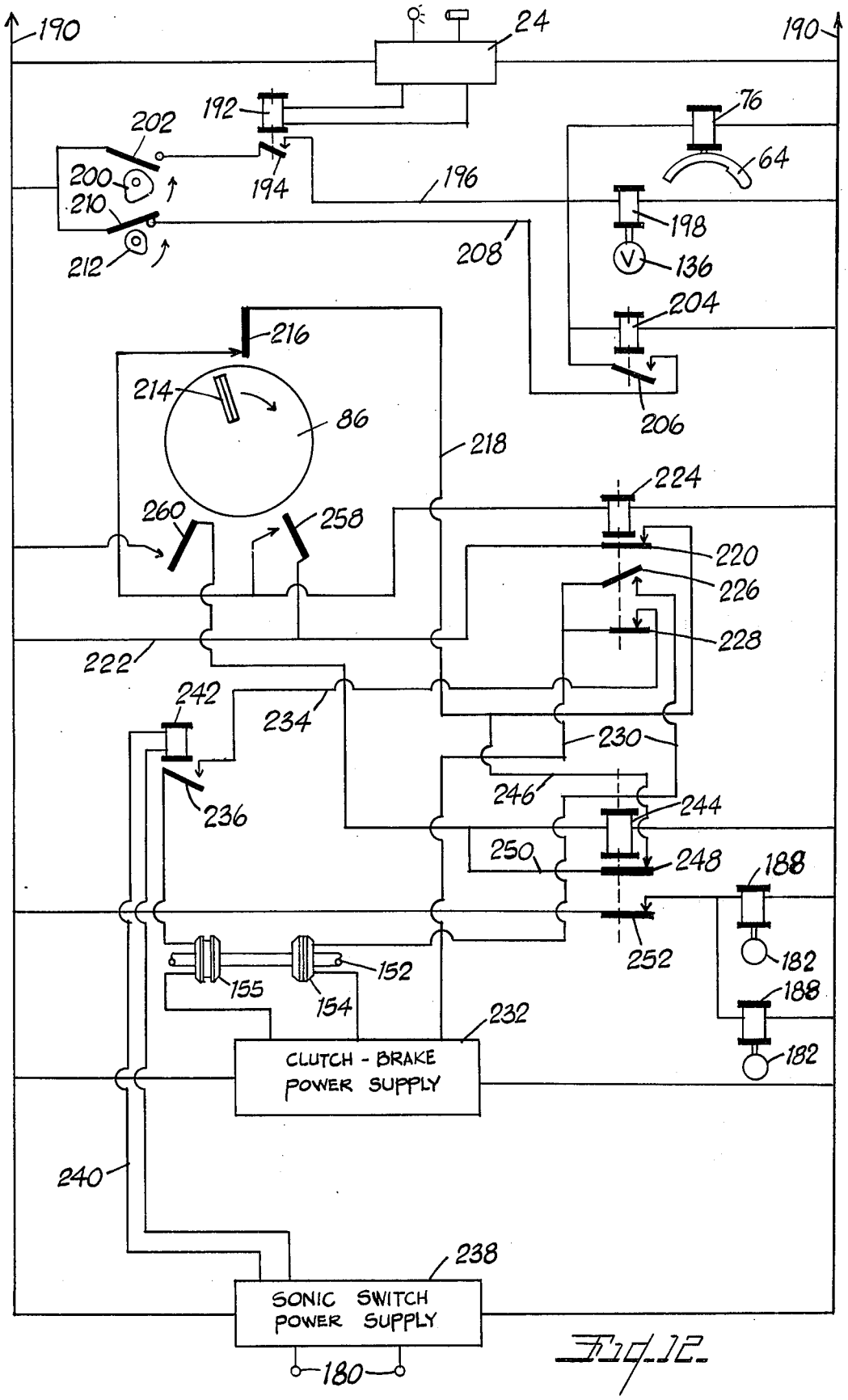
FIG. 12 is a schematic diagram of the control system of the machine.

FIG. 12 shows the circuit diagram for controlling the wrapper film and individual wrapper feed. Main power conductors 190 supply current to the several control circuits when the machine is turned on. The photo-electric switch 24 senses the presence of articles on the conveyor ready to be wrapped and energized solenoid 192. This closes switch 194 in circuit 196 to solenoid 76, and to solenoid 198 for actuating valve 136 which activates the cylinders 134 which raise the striker bars 112 and 114 into operative relation to the cutters. When solenoid 76 is energized, blocking or trip bar 74 is held up out of contact with clutch pawl 64 so the pawl is urged into driving engagement with notch 72 in disc 60 by spring 70 (FIG. 6). However, circuit 196 is energized only when a cam 200 closes a switch 202. A holding circuit is set up by relay 204 which closes switch 206 in circuit 208 to a second cam actuated switch 210 which is normally closed but is opened each cycle by the cam 212. Should photo switch 24 give a false signal, as by passage of the flight bar 16 of an empty flight on supply conveyor 10, or fail to be closed during approximately 82° when cam switch 202 is closed, circuit 196 will remain open. Recall that clutch pawl 64 can only be engaged in one position in the cycle of the machine, and that once engaged it will remain engaged for a full cycle. Cam actuated switch 210 opens the holding circuit 208 during about 12° of the cycle during the latter part of the closed position of switch 202. Thus, so long as there is a continuous supply of articles on conveyor 10, photo switch 24 and relay 192 will hold switch 194 closed, and clutch 64 will remain engaged. Also striker bars 112 and 114 will remain raised. While holding circuit 208 is broken momentarily each cycle by switch 210, this occurs when switch 202 is closed and the holding circuit is reestablished before switch 202 opens.

As illustrated in FIG. 12, clutch 64 may be considered as engaged and rotating at the end of a previous cycle as the result of simultaneous closing of switches 202 and 194. Solenoid 198 will have actuated valve 136 and the striker bars 112 and 114 to cut off a single wrapper from the supply roll. Reed switch assembly 86 will be rotating its magnet 214 toward normally closed switch 216, and a holding circuit 218 though normally open, but now closed, relay switch 220 to supply conductor 222 will be energized to relay 224, so relay switch 226 will be open and relay switch 228 will be closed. In this condition circuit 230 from the clutch brake power supply 232 will be open at switch 226 so clutch 154 will be deenergized, and wrapper locating belts 158 will be slowing down. Brake circuit 234 will be closed at switch 228, but will be open at relay switch 236.

As the decelerating belts 158 advance the leading edge of the severed wrapper sheet between the sending and receiving elements of the sonic sensor 180, the power supply 238 will energize circuit 240 and solenoid 242 to close switch 236 and the brake 155 will be activated. This stops the belts and the wrapper sheet in exactly the right position to be engaged by the article being raised in the previous cycle by elevator 18.

During this same period, solenoid 244 will be energized through branch holding circuit 246 from holding circuit 218 to holding switch 248 and connecting conductor 250 to hold relay 244 energized. Switch 252 to solenoids 188 will be closed energizing the solenoids to lift rollers 182 away from the belts 158 after the belts are stopped by brake 155.

The start of a new cycle may be considered to take place shortly thereafter when the magnet of reed switch 86 rotates past normally closed switch 216 to open that switch. Note that if photo switch 24 and its relay operated switch 194 have not actuated circuit 196 at that time, clutch 64 will disengage and the film feed drive rolls 104 will stop as cam 212 passes switch 210 so there will be no continuing feed of wrapper sheets. However, assuming normal supply of articles to the elevator 18, momentary opening of reed switch 216 breaks holding circuit 218 and branch holding circuit 246 to solenoids 224 and 244. Relay switches 220, 228, 248 and 252 open, and relay switch 226 closes. Pressure rollers 182 are lowered by spring or gravity to the wrapper sheet to hold the incoming sheet against the locating belts 158. At the same time relay switch 226 closes in circuit 230 so clutch 154 is engaged and locating belts 158 start. Feed belts 162 are operating continuously, and feed rollers 104 continue to rotate in the new cycle, so a new length of wrapper film starts to feed under cutter bars 56 and 48. Feed of the new wrapper length continues through about 170° of rotation of reed switch 86 during which time the cutter bars cut off the new wrapper sheet and until the magnet closes switch 258 to close the energizing circuit from 222 to relay 224. The holding circuit from 222 closes at switch 220 and continues through 218 and then closed reed switch 216 to solenoid 224. Relay switch 226 in clutch circuit 230 opens so the clutch is deenergized and the wrapper locating belts start to slow down. Relay switch 228 closes so brake circuit 234 is partial complete but remains open at switch 236 under control of the sonic switch 180. After about 40° of further rotation of reed switch assembly 86, reed switch 260 closes in circuit to relay 244, closing its switches 248 and 252. Closing of switch 252 energizes solenoids 188 to raise the pressure rollers 182 from the belts 158. A holding circuit for relay 244 is established through switch 248, conductor 250 and branch holding circuit 246. This remains closed during the about 170° rotation of reed switch to switch 216 and the start of the next cycle. It is during this latter portion of the cycle that sonic switch 180 energizes relay 242 to activate the brake, and the article is pushed up from under the wrapper sheet, pulling the edges of the sheet transversely from under the balls 176 and draping the sheet over the article. The partially wrapped article is removed from over the belts 158 before the next cycle starts.

What is claimed as new is:

1. In a wrapping machine having a vertically reciprocating elevator for lifting articles to be wrapped from a supply conveyor having article advancing flights, wrapper sheet locating belts for locating a sheet of wrapper film over the path of articles elevated by said elevator, feed rolls for delivering wrapper film stock to said locating belts, a rotating cutter bar located over the film stock between said feed rolls and said locating belts, means for coordinating the action of said elevator, said supply conveyor, said feed rolls, said locating belts, and said cutter bar comprising:

first drive connections connected to continuously rotate said cutter bar through one revolution and reciprocate said elevator in timed relation to the advance of each flight of said conveyor, a normally engaged single position mechanical clutch rotatable through one cycle with each rotation of said cutter bar and having a disengaging pawl adapted to disengage the clutch at the start of any rotational cycle thereof, an article sensing switch connected to close a first solenoid switch responsive to presence of an article to be wrapped, a first timing cam driven continuously with said conveyor and arranged to close an energizing switch in series with said sensing switch prior to and during the start of each cycle of said clutch, said switches being connected to energize a solenoid adapted to retract the disengaging pawl of said clutch whereby the clutch remains engaged for a following full cycle, a holding solenoid and circuit energized by said cam operated switch, a second normally closed and continuously driven cam operated switch connected in series in said holding circuit and arranged to momentarily open the holding circuit to the solenoid of said clutch pawl during the latter part of the closed cycle of said first cam driven switch, said feed rolls being connected to be driven through said clutch, a striker bar rockably supported under the incoming film of wrapper stock and movable into coacting relation with said cutter bar, a solenoid operated valve connected to a cylinder to swing said striker bar into coacting cutting relation to said cutter bar, the solenoid of said valve being connected to said energizing switch for actuation of said striker bar with said solenoid for retracting said clutch pawl, a sequence switch driven with said conveyor and making one revolution during each revolution of the mechanical clutch and arranged to successively and momentarily open one switch and close two switches during each cycle, a shaft having a sprocket rotatable thereon, the sprocket being driven continuously with said cutter bar, an electric clutch adapted to connect said sprocket to said shaft, said wrapper locating belts being driven from said shaft, an electric brake arranged when energized to stop said shaft and said locating belts, pressure rollers swingably positioned over said locating belts and biased against said locating belts and wrapper sheets thereon, solenoids connected to raise said pressure rollers from said belts, sensing means positioned to sense the arrival of the leading edge of a wrapper sheet in said belts at the desired position over said elevator, a normally open switch connected in the energizing circuit to said brake and arranged to be closed by actuation of said sensing means, and circuit control means connected to be activated by said sequence switch to successively (a) de-activate the energizing circuit to said brake, and open a holding circuit to deenergize the solenoids holding said pressure rollers raised and to simultaneously close the energizing circuit to said electric clutch to start said wrapper locating belts at the end of one cycle and the start of a succeeding cycle, then (b) close a first normally open switch to a solenoid to open the energizing circuit to said electric clutch whereby said locating belts start to decelerate, and close one switch in the energizing circuit to said brake, and then (c) close a second normally open switch to the solenoid to energize the solenoids to raise said pressure rollers from said wrapper sheet locating belts, and reenergize said electric clutch to drive said locating belts.

2. In a wrapping machine having a vertically reciprocating elevator for lifting articles to be wrapped from a supply conveyor having article advancing flights, wrapper sheet locating belts for locating a sheet of wrapper film over the path of articles elevated by said elevator feed rolls for delivering wrapper film stock, a rotating cutter bar located over the film stock, means for coordinating the action of said elevator, said supply conveyor, said feed rolls, said locating belts, and said cutter bar comprising:

first drive connections connected to rotate said cutter bar through one revolution and reciprocate said elevator in timed relation to the advance of each flight of said conveyor, a normally engaged single position clutch rotatable through one cycle with each rotation of said cutter bar and having a disengaging pawl adapted to disengage the clutch at the start of each rotational cycle thereof, said feed rolls being connected to be driven from said clutch and arranged to feed a wrapper length of wrapper film to said cutter bar during each cycle of the clutch, an article sensing switch connected to close a first solenoid switch responsive to presence of an article to be wrapped, a first timing cam driven in the same cycle as said clutch and arranged to close an energizing switch in series with said sensing switch, said energizing switch and said sensing switch being connected to a solenoid adapted to retract the disengaging pawl of said clutch whereby the clutch remains engaged for a full cycle, a holding solenoid and circuit closed and energized by said cam operated switch, a second timing cam driven with said first cam and arranged to open a normally closed switch connected in series with said holding circuit to open the holding circuit to the solenoid of said clutch pawl after a portion of the cycle of said clutch, sequentially operating switch means connected to be driven through one cycle during each revolution of the clutch and arranged to successively and momentarily actuate three switches during each cycle, an electric clutch arranged to drive said locating belts when energized, an electric brake arranged when energized to stop said locating belts, pressure rollers swingably positioned over said locating belts and biased into contact with the belts and having solenoid actuated means to lift the rollers from a wrapper sheet on said locating belts, sensing means positioned to sense the arrival of the leading edge of a wrapper sheet at the desired position over said elevator, a normally open switch connected in the energizing circuit to said brake and arranged to be closed by actuation of said sensing means, and circuit control means connected to be activated by said sequential switch means to successively (a) de-activate the energizing circuit to said brake and open a holding circuit holding said pressure rollers raised, and to simultaneously close the energizing circuit to said clutch to start said wrapper locating belts at the end of one cycle and start of a succeeding cycle, then (b) activate a second switch after less than half a cycle of the sequential switch means to open the energizing circuit to said clutch whereby said locating belts start to decelerate, and close one switch in the energizing circuit to said brake, and then (c) after more than half the cycle of said sequential switch means activate the third switch to energize the solenoid means to raise said pressure rollers from said wrapper sheet locating belts, and reenergize said clutch to drive said locating belts.

3. In a wrapping machine having feed rolls arranged to deliver a web of wrapper stock to delivery belts, and a rotating cutter bar located transversely across the stock so delivered, an article delivery conveyor arranged to advance articles to be wrapped to wrapping position, and having an article sensing switch associated therewith, a swingable striker bar movable from the opposite side of said web of wrapper stock from said cutter bar into coacting cutting relation with the cutter bar, power means connected to move said striker bar into operative position, and switch means driven in timed relation to said cutter bar and connected in series with said sensing switch to control said power means to move said striker bar to cutting position.

4. The combination as defined in claim 3 in which said switch means includes a normally open switch closed during a first part of the wrapping cycle and connected in series with said sensing switch, and a solenoid arranged to actuate said power means and a holding circuit for the solenoid, and a normally closed switch connected in series in said holding circuit and opened momentarily during the latter part of the closed condition of said normally open switch.

5. In a wrapping machine having means including locating belts for advancing wrapper sheets to a position to be wrapped, and means to stop said belts at a wrapping position, pressure rollers rotatable about axes transverse to the belts and swingably supported over said belts and normally held in rolling contact with said belts to hold said sheets against said belts, and means arranged to raise said pressure rollers from said sheets and said belts when said belts are stopped.

6. A wrapping machine as defined in claim 5 in which there are weighted balls retained in rolling contact with said sheets over said belts ahead of said pressure rollers.

7. A wrapping machine as defined in claim 6 in which there is a sensing device positioned to sense the arrival of the leading edge of said wrapper sheet at the wrapping position, and control means actuated by said sensing device connected to stop said belts when said device senses the arrival of the wrapper sheet at the wrapping position.

8. A wrapping machine as defined in claim 7 in which said sensing device is an ultra-sonic transducer having sending and receiving elements located on opposite sides of the path of advance of said wrapper sheets by said belts.

* * * * *